US010993009B2

(12) United States Patent
Bacon et al.

(10) Patent No.: US 10,993,009 B2
(45) Date of Patent: Apr. 27, 2021

(54) EARPHONE

(71) Applicant: Bose Corporation, Framingham, MA (US)

(72) Inventors: Cedrik Bacon, Ashland, MA (US); Daniel R. Collins, Waltham, MA (US); Natalie Zucker, Allston, MA (US); Keith L. Davidson, Brighton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/241,144

(22) Filed: Jan. 7, 2019

(65) Prior Publication Data

US 2020/0221202 A1 Jul. 9, 2020

(51) Int. Cl.
*H04R 1/10* (2006.01)

(52) U.S. Cl.
CPC ..... *H04R 1/1016* (2013.01)

(58) Field of Classification Search
CPC .. H04R 1/1016; H04R 1/1075; H04R 1/2803; H04R 1/2811; H04R 1/2826; H04R 1/2842; H04R 1/2849; H04R 1/2896; H04R 25/604; H04R 2460/11
See application file for complete search history.

(56) References Cited

U.S. PATENT DOCUMENTS 4,239,945 A * 12/1980 Atoji ..... H04R 1/2819 381/349
5,208,868 A 5/1993 Sapiejewski
6,567,524 B1 5/2003 Svean et al.
6,704,429 B2 * 3/2004 Lin ..... H04R 1/1016 181/130
6,831,984 B2 12/2004 Sapiejewski
7,039,195 B1 5/2006 Svean et al.
7,317,802 B2 1/2008 Wurtz
7,916,888 B2 3/2011 Sapiejewski et al.
8,199,955 B2 * 6/2012 Akino ..... H04R 1/1008 381/332
8,755,558 B2 * 6/2014 Saiki ..... H04R 9/063 181/171

(Continued)

FOREIGN PATENT DOCUMENTS

EP 3340644 A1 6/2018
JP 7095876 B * 10/1995

(Continued)

OTHER PUBLICATIONS

The International Search Report and the Written Opinion dated Oct. 21, 2014 by the International Searching Authority for PCT Application No. PCT/US2014/040142.

(Continued)

*Primary Examiner* — Ryan Robinson
(74) *Attorney, Agent, or Firm* — Brian M. Dingman; Dingman IP Law, PC

(57) ABSTRACT

An earphone with a first acoustic cavity, a second acoustic cavity, and an electro-acoustic transducer configured to deliver acoustic energy into the first and second acoustic cavities. A port acoustically couples one of the first and second acoustic cavities to a different volume. The port comprises an opening with a mesh structure that is insert molded into the port.

16 Claims, 5 Drawing Sheets

(56) References Cited

U.S. PATENT DOCUMENTS

| | | | | |
|---|---|---|---|---|
| 8,989,424 | B2 * | 3/2015 | Sibbald | H04R 1/10 381/371 |
| 8,989,427 | B2 * | 3/2015 | Silvestri | H04R 1/1016 381/380 |
| 9,237,394 | B2 * | 1/2016 | Seo | H04R 1/1016 |
| 9,319,767 | B2 * | 4/2016 | Sakaguchi | H04R 1/2811 |
| 9,883,280 | B2 * | 1/2018 | Oosato | H04R 1/2826 |
| 10,034,076 | B2 * | 7/2018 | Matsuo | H04R 11/02 |
| 10,390,143 | B1 * | 8/2019 | Wakeland | H04R 1/2888 |
| 2005/0077102 | A1 | 4/2005 | Banter et al. | |
| 2008/0002835 | A1 | 1/2008 | Sapiejewski et al. | |
| 2011/0058704 | A1 | 3/2011 | Harlow | |
| 2012/0039500 | A1 | 2/2012 | Silvestri et al. | |
| 2012/0201406 | A1 * | 8/2012 | Yamaguchi | H04R 1/1016 381/309 |
| 2012/0314882 | A1 * | 12/2012 | Sibbald | H04R 1/1016 381/71.6 |
| 2013/0142375 | A1 * | 6/2013 | Sung | H04R 1/1075 381/373 |
| 2014/0140565 | A1 * | 5/2014 | Liu | H04R 1/1091 381/380 |
| 2015/0078609 | A1 * | 3/2015 | Tseng | H04R 1/1016 381/386 |
| 2017/0223443 | A1 * | 8/2017 | Silvestri | H04R 1/1091 |
| 2018/0270558 | A1 * | 9/2018 | Ring | H04R 1/023 |

FOREIGN PATENT DOCUMENTS

| | | | | |
|---|---|---|---|---|
| JP | 2005191663 | A | * | 7/2005 |
| JP | 3798402 | B2 | * | 7/2006 |
| WO | 01/03470 | A1 | | 1/2001 |

OTHER PUBLICATIONS

The International Search Report and the Written Opinion dated Jun. 25, 2020 by the International Searching Authority for PCT Application No. PCT/US2020/012524.

* cited by examiner

EARPHONE

BACKGROUND

This disclosure relates to an earphone.

Earphones may have one or more ports. The ports can be used, for example, to tune the acoustic performance of the earphone or deliver sound into the ear canal. Ports can comprise an opening with a mesh material covering the opening.

SUMMARY

All examples and features mentioned below can be combined in any technically possible way.

In one aspect, an earphone includes a first acoustic cavity, a second acoustic cavity, an electro-acoustic transducer configured to deliver acoustic energy into the first and second acoustic cavities, and a port that acoustically couples one of the first and second acoustic cavities to a different volume, wherein the port comprises an opening with a mesh structure that is insert molded into the port.

Examples may include one of the above and/or below features, or any combination thereof. The port may directly acoustically couple the first and second acoustic cavities. The earphone may further comprise a frame that supports the transducer, and the port may be integrated into the frame. The frame may comprise an annular seat for the transducer, and an integral extension that comprises the port. The port may comprise a port opening in the integral extension. There may also be a bead of material on the extension and proximate the port opening.

Examples may include one of the above and/or below features, or any combination thereof. The port may comprise an acoustically resistive element. The port may comprise an acoustically reactive element. The port may comprise a tube. The port may acoustically couple the second acoustic cavity to an environment external to the earphone. The port may comprise a nozzle that is configured to directly deliver acoustic energy into an ear canal. The mesh structure may comprise a moisture-resistant element.

Examples may include one of the above and/or below features, or any combination thereof. The mesh structure may comprise a moisture-resistant element. The mesh structure may comprise a woven mesh material. The port may acoustically couple the first acoustic cavity to an environment external to the earphone.

In another aspect, an earphone includes a front acoustic cavity, a rear acoustic cavity, an electro-acoustic transducer configured to deliver acoustic energy into the front and rear acoustic cavities, and an internal port that directly acoustically couples the front and rear acoustic cavities, wherein the port comprises an opening with an acoustically resistive woven mesh material that is insert molded into the port.

Examples may include one of the above and/or below features, or any combination thereof. The earphone may further comprise a frame that supports the transducer, wherein the port is integrated into the frame. The frame may comprise an annular seat for the transducer, and an integral extension that comprises the port. The earphone may further comprise a mass port and a resistive port that acoustically couple the rear cavity to an environment external to the earphone. The earphone may further comprise a nozzle that is configured to directly deliver acoustic energy from the front cavity into an ear canal. The earphone may further comprise a moisture-resistant element mesh material that is insert molded into the nozzle. The earphone may further comprise an external port that acoustically couples the rear cavity to an environment external to the earphone and comprises an opening with a woven mesh material that is insert molded into the external port.

DETAILED DESCRIPTION

Earphones often use mesh material to provide a desired acoustic resistance in one or more ports of the earphone. Mesh materials can also be used to cover port openings so as to inhibit moisture or particulate ingression without substantial acoustic resistance. The mesh materials are typically applied in a post-molding operation, which increases earbud production costs and can lead to inhibited performance due to variation in performance between products. Integrating the mesh material into the port by insert molding the mesh in the earphone mold tool does away with the post-molding operation and leads to greater earphone operational uniformity. In addition, integrating the mesh material and attendant port into the frame of the electro-acoustic transducer simplifies assembly.

An earphone or a headphone refers to a device that typically fits around, on, in, or near an ear and that radiates acoustic energy into or towards the ear canal. Headphones and earphones are sometimes referred to as earpieces, headsets, earbuds, or sport headphones, and can be wired or wireless. An earphone includes an electro-acoustic transducer to transduce audio signals to acoustic energy. The electro-acoustic transducer may be housed in an earcup, earbud, or other housing. Some of the figures and descriptions following show a single earphone device. An earphone may be a single stand-alone unit or one of a pair of earphones (each including at least one electro-acoustic transducer), one for each ear. An earphone may be connected mechanically to another earphone, for example by a headband and/or by leads that conduct audio signals to an electro-acoustic transducer in the headphone. An earphone may include components for wirelessly receiving audio signals. An earphone may include components of an active noise reduction (ANR) system. Earphones may also include other functionality, such as a microphone. An earphone may also be an open-ear device that includes an electro-acoustic transducer to radiate acoustic energy towards the ear canal while leaving the ear open to its environment and surroundings.

In an around-the-ear, on-the-ear, or off-the-ear earphone, the earphone may include a headband and at least one housing that is arranged to sit on or over or proximate an ear of the user. The headband can be collapsible or foldable, and can be made of multiple parts. Some headbands include a slider, which may be positioned internal to the headband, that provides for any desired translation of the housing. Some earphones include a yoke pivotably mounted to the headband, with the housing pivotably mounted to the yoke, to provide for any desired rotation of the housing.

Figure 1:
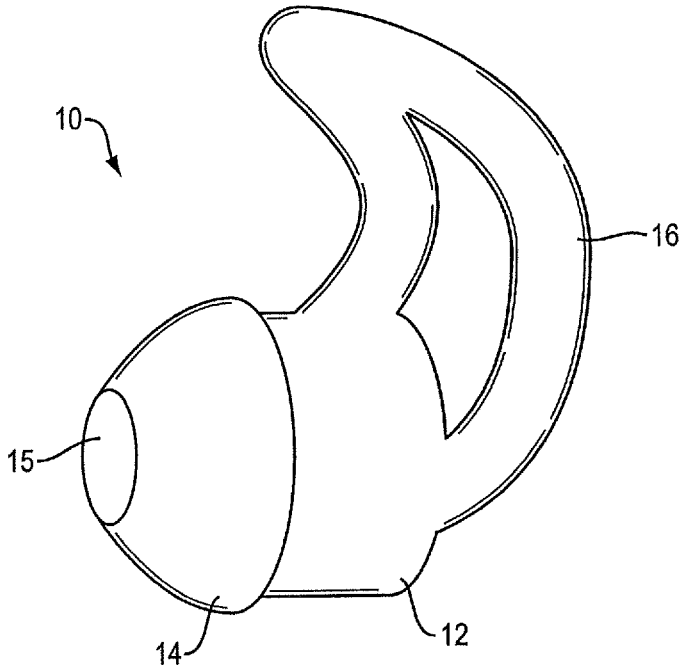
FIG. 1 is perspective view of an earphone.

FIG. 1 is a perspective view of in-ear headphone, earphone, or earbud 10. Earphone 10 includes body 12 that houses the active components of the earbud. Ear tip portion 14 is coupled to body 12 and is pliable so that it can be inserted into at least the entrance of the user's ear canal. Sound is delivered through opening 15. Retaining loop 16 is constructed and arranged to be positioned in the outer ear, for example in the antihelix, to help retain the earbud in the ear. Earphones and earbuds are well known in the field (e.g., as disclosed in U.S. Pat. Nos. 9,854,345 and 8,989,427, the disclosures of which are incorporated herein by reference in their entirety and for all purposes), and so certain details of the earbud are not further described herein. An earbud is an example of an earphone according to this disclosure, but is not limiting of the scope, as earphones can also be located on or over the ear, or even on the head near the ear.

Figure 2:
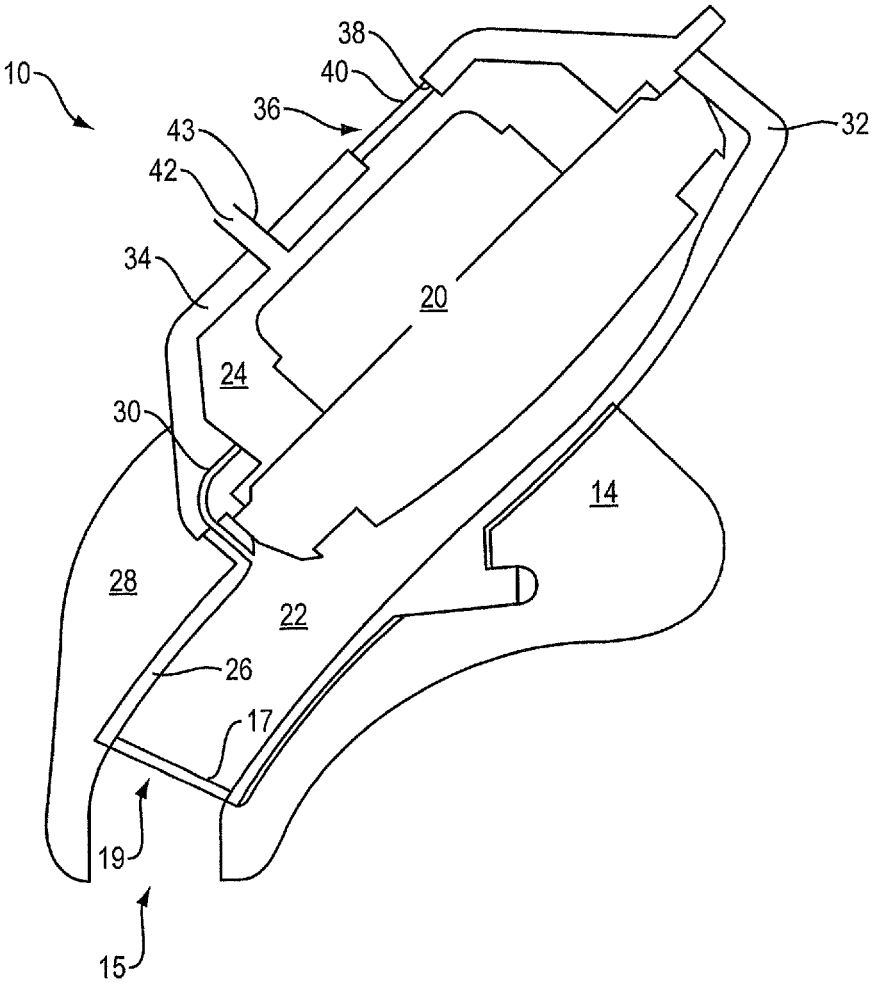
FIG. 2 is a cross-sectional view of selected parts of an earphone.

As shown in FIG. 2, earphone 10 includes a rear acoustic chamber 24 and a front acoustic chamber 22 defined by shells 34 and 32 of the housing, respectively, on either side of an electro-acoustic transducer 20. Note that in the drawings and the following description, non-limiting values of some variables are used. These values represent specific non-limiting examples, it being understood that the disclosure is in no way limited by these examples. In some examples, a 14.8 mm or 9.7 mm diameter electro-acoustic transducer can be used. Other sizes and types of electro-acoustic transducers could be used depending, for example, on the desired frequency response and performance of the earphone. The electro-acoustic transducer 20 separates the front and rear acoustic chambers 22 and 24. The shell 32 of the housing extends the front chamber 22 via nozzle 26 to at least the entrance to the ear canal 28, and in some examples into the ear canal 28, through the ear tip portion 14 and ends at an opening 15 that may include element 17 that can be an acoustic resistance element or a moisture or particulate barrier element, for example. Element 17 may be a mesh structure. In some examples, element 17 is located within nozzle 26 rather than at the end, as illustrated. An acoustic resistance element dissipates a proportion of acoustic energy that impinges on or passes through it. In other examples, no resistance element is included, but a screen may be used in its place to prevent or inhibit moisture or debris from entering the front chamber 22. The front chamber 22 does not have a pressure equalization (PEQ) port to connect the chamber 22 to an environment external to the earphone.

Instead, a PEQ port 30 acoustically couples the front acoustic chamber 22 and the rear acoustic chamber 24. The port 30 serves to relieve air pressure that could be built up within the ear canal 28 and front chamber 22 when (a) the earphone 10 is inserted into or removed from the ear canal, (b) a person wearing the earphone 10 experiences shock or vibration, or (c) the earphone 10 is struck or repositioned while being worn. The port 30 preferably has a diameter of between about 0.25 mm to about 3 mm. The port 30 preferably has a length of between about 0.25 mm to about 10 mm. Port 30 can have a mesh structure (not shown) if desired, to alter the impedance of the port or provide environmental protection.

The amount of passive noise reduction that can be provided by a ported earphone is often limited by the acoustic impedance through the ports, and the air volume in front of or behind the electrodynamic transducer. Generally, more passive noise reduction is preferable. However, certain port geometry is often needed in order to have proper system performance. Ports can be used to improve acoustic output, equalize audio response, and provide a venting path during overpressure events. Impedance may be changed in a number of ways, some of which are related. Impedance is frequency dependent, and it may be preferable to increase impedance over a range of frequencies and/or reduce the impedance at another range of frequencies. The impedance has two components: a resistive component (DC flow resistance) and a reactive either mass component jar or compliance $1/j\omega$. The total impedance can be calculated at a specific frequency of interest by determining the magnitude or absolute value of the acoustic impedance $|z|$. The port 30 can have a desired absolute value $|z|$ acoustic impedance at different frequencies.

The primary purpose of the port 30 is to avoid an over-pressure condition when, e.g., the earphone 10 is inserted into or removed from the user's ear 10, or during use of the earphone. Pressure built up in the front acoustic chamber 22 escapes to the rear acoustic chamber 24 via the port 30, and from there to the environment via back cavity ports 42 and 36, mainly the mass port 42 (discussed in more detail below). Additionally, the port 30 can be used to provide a tuned amount of leakage that acts in parallel with other leakage that may be present. This helps to standardize response across individuals. Adding the port 30 makes a tradeoff between some loss in low frequency output and more repeatable overall performance. The port 30 provides substantially the same passive attenuation as completely blocking a typical front chamber PEQ port with similar architecture. The port 30 in series with the rear cavity ports 42 and 36 provides a higher impedance venting leak path compared with using a traditional front chamber PEQ instead of the port 30. Surprisingly, however, it was found that this higher impedance results in a more linear behavior during pressure equalization events which reduces the negative impact of the higher impedance.

The rear chamber 24 is sealed around the back side of the electro-acoustic transducer 20 by the shell 34 except that the rear chamber 24 includes one or both of a reactive element, such as a port (also referred to as a mass port) 42, and a resistive element, which may also be formed as a port 36. The reactive element 42 and the resistive element 36 acoustically couple the rear acoustic chamber 24 with an environment external to the earphone, thereby relieving the air pressure mentioned above. U.S. Pat. No. 6,831,984 describes the use of parallel reactive and resistive ports in a headphone device, and is incorporated herein by reference. Although we refer to ports as reactive or resistive, in practice any port will have both reactive and resistive effects. The term used to describe a given port indicates which effect is dominant. A reactive port like the port 42 is, for example, a tube-shaped opening in what may otherwise be a sealed acoustic chamber, in this case rear chamber 24. A resistive element like the port 36 can be, for example, a small opening 38 in the wall 34 of acoustic chamber 24, covered by a material 40 that provides an acoustical resistance, for example, a wire or fabric screen (mesh) that allows some air and acoustic energy to pass through the wall of the chamber.

The reactive element 42 can have an absolute value acoustic impedance $|z|$ in a desired range, which may differ at different frequencies. The resistive element 36 may have a desired acoustic impedance. The reactive element 42 preferably has a diameter of between about 0.5 mm to about 2 mm, and more preferably has a diameter of about 1 mm. The reactive element 42 preferably has a length of between about 5 mm to about 25 mm, and more preferably has a length of about 15 mm. The resistive element 36 preferably has a diameter of about 1.7 mm and a length of preferably about 1 mm covered with a 260 rayls or 160 rayls resistive material (e.g. woven cloth) 40. These dimensions provide both the acoustic properties desired of the reactive port 42, and an escape path for the pressure built up in the front chamber 22 and transferred to the rear chamber 24 by the port 30. The ports 42 and 36 provide porting from the rear acoustic chamber 24 to an environment external to the earphone. Furthermore, in order to receive a meaningful benefit in terms of passive attenuation when using a front to back port 30 in a ported system, the ratio of the impedance of the ports 42 and 36 to the impedance of the port 30 is preferably greater than 0.25 and more preferably around 1.6 at 1 kHz.

For an active noise reduction (ANR) earphone two functions (of many) of the ports 30, 42 and 36 are to increase the output of the system (improves active noise reduction) and provide pressure equalization. In addition, it is desirable to maximize the impedance of these ports at frequencies that can improve the total system noise reduction. At certain frequencies (e.g., at low frequency) it may be preferable for the impedance to allow for venting pressure or increasing low frequency output, and at certain other frequencies (e.g., at 1 kHz) it may be preferable for the impedance to be different in order to maximize passive noise reduction. Ports allow this to occur as they can have a different resistive DC component from the reactive frequency dependent component depending upon their design.

Any one or more of the ear tip portion 14, cavities 24 and 22, electro-acoustic transducer 20, screen 17, port 30, and elements 42 and 36, can have acoustic properties that may affect the performance of the earphone 10. These properties may be adjusted to achieve a desired frequency response for the earphone. Additional elements, such as active or passive equalization circuitry, may also be used to adjust the frequency response. The rear chamber 24 preferably has a volume of between about 0.1 $cm^3$ to about 3.0 $cm^3$, and more preferably has a volume of about 0.5 $cm^3$ (this volume includes a volume behind a diaphragm of the electro-acoustic transducer 20 (inside the transducer), but does not include a volume occupied by metal, pcb, plastic or solder). Excluding the electro-acoustic transducer, the front chamber 22 preferably has a volume of between about 0.05 $cm^3$ to about 3 $cm^3$, and more preferably has a volume of about 0.25 $cm^3$.

The reactive port 42 resonates with the back chamber volume. In some examples, the reactive port 42 and the resistive port 36 provide acoustical reactance and acoustical resistance in parallel, meaning that they each independently couple the rear chamber 24 to free space. In contrast, reactance and resistance can be provided in series in a single pathway, for example, by placing a resistive element such as a wire mesh screen inside the tube of a reactive port. In some examples, a parallel resistive port is made from an 80×700 Dutch twill wire cloth, for example, that available from Cleveland Wire of Cleveland, Ohio, and has a diameter of about 1.7 mm. Parallel reactive and resistive elements, embodied as a parallel reactive port and resistive port, provides increased low frequency response compared to an example using a series reactive and resistive elements. The parallel resistance does not substantially attenuate the low frequency output while the series resistance does. Using a small rear cavity with parallel ports allows the earphone to have improved low frequency output and a desired balance between low frequency and high frequency output.

Some or all of the elements described above can be used in combination to achieve a particular frequency response (non-electronically). In some examples, additional frequency response shaping may be used to further tune sound reproduction of the earphones. One way to accomplish this is with passive electrical equalization using circuitry (not shown). Such circuitry can be housed in-line with the earphones or within the housing of the earphones, for example. If active noise reduction circuitry or wireless audio circuitry is present, such powered circuits may be used to provide active equalization.

Any one or more of the ports (e.g., ports 19, 30, 36, and/or 42) can comprise an opening that is covered by a mesh structure. The mesh structure can be coupled to the structure that forms the port (e.g., the housing) by insert molding the mesh structure into the port. The mesh can be insert molded across the port at any location along the length of the port, up to and including either surface at the ends of the port. Insert molding is known in the field of plastic injection molding, and involves placing the mesh structure into a particular location in the mold tool and then injecting plastic that partially encapsulates the mesh structure while at the same time foaming part or all of the structure that defines the port. For example, mesh structure 40 can be insert molded into shell 34. As described below, a mesh structure 40 could likewise be insert molded to a frame of an electro-acoustic transducer as part of front-to-back PEQ 30.

Insert molding of a mesh structure into a port of an earphone can substantially improve the earphone and simplify its fabrication. Insert molding is a variation on the same fundamental injection molding process which is already used to produce various parts of the earbud (e.g., shells 32 and 34), including the opening of ports 30, 36, and 42. Accordingly, there are no extra steps needed in order to fix the mesh structure to the port. This is in contrast to the current fabrication approaches that involve post-molding operations such as adhering the mesh material into the port (e.g., using a pressure sensitive adhesive (PSA)) or heat staking the mesh material into the port (which involves softening a thermoplastic port material post-molding and embedding the mesh material into the softened plastic, which then hardens and encapsulates the mesh). Insert molding can thus save time and effort during earbud fabrication. Also, insert molding is reliable in its ability to properly encapsulate the edges of the mesh material while leaving the material that spans the port opening open. This leads to less chance of acoustic leakage or water leakage around the mesh compared to the use of PSA, which can lead to incomplete adhesion and thus leakage, or even to the failure of the adhesive joint. As long as the edges of the mesh are encapsulated through the insert molding process, these benefits in consistency of seal and mesh integrity can be realized. Although benefits in ease of assembly are maximized when the port opening is integral to a larger structure, in its simplest form the port may be a stand-alone injection molded component comprising just a frame of injection molded plastic capturing the edges of the mesh. Adhering such a rigid plastic frame onto surrounding structure is a far less sensitive process than capturing the edges of the mesh. This type of variation may be used in cases where the plastic component containing the port opening is produced by sufficiently complex molding and tooling such that insert molding is no longer feasible. Also, with insert molding the port structure itself and the port opening are left intact and untouched. In contrast, the PSA in an adhesive joint and the softened and re-hardened plastic in a heat-staked joint can partially block the port and have an effect on the acoustic performance of the port. Insert molding is also a repeatable, mostly or fully-automated process, leading to less variation between products. The product consistency also allows acoustic earphone considerations, such as active noise reduction, to be implemented more aggressively than might be the case where there could be more variation product-to-product.

As is known in the technical field, the mesh structure can be designed to create an acoustic resistance and/or it can be used for environmental protection purposes, for example to inhibit the passage of moisture and/or particles. The mesh structures can comprise woven or non-woven meshes. The mesh can be made of plastic, metal, or another material.

Figure 3:
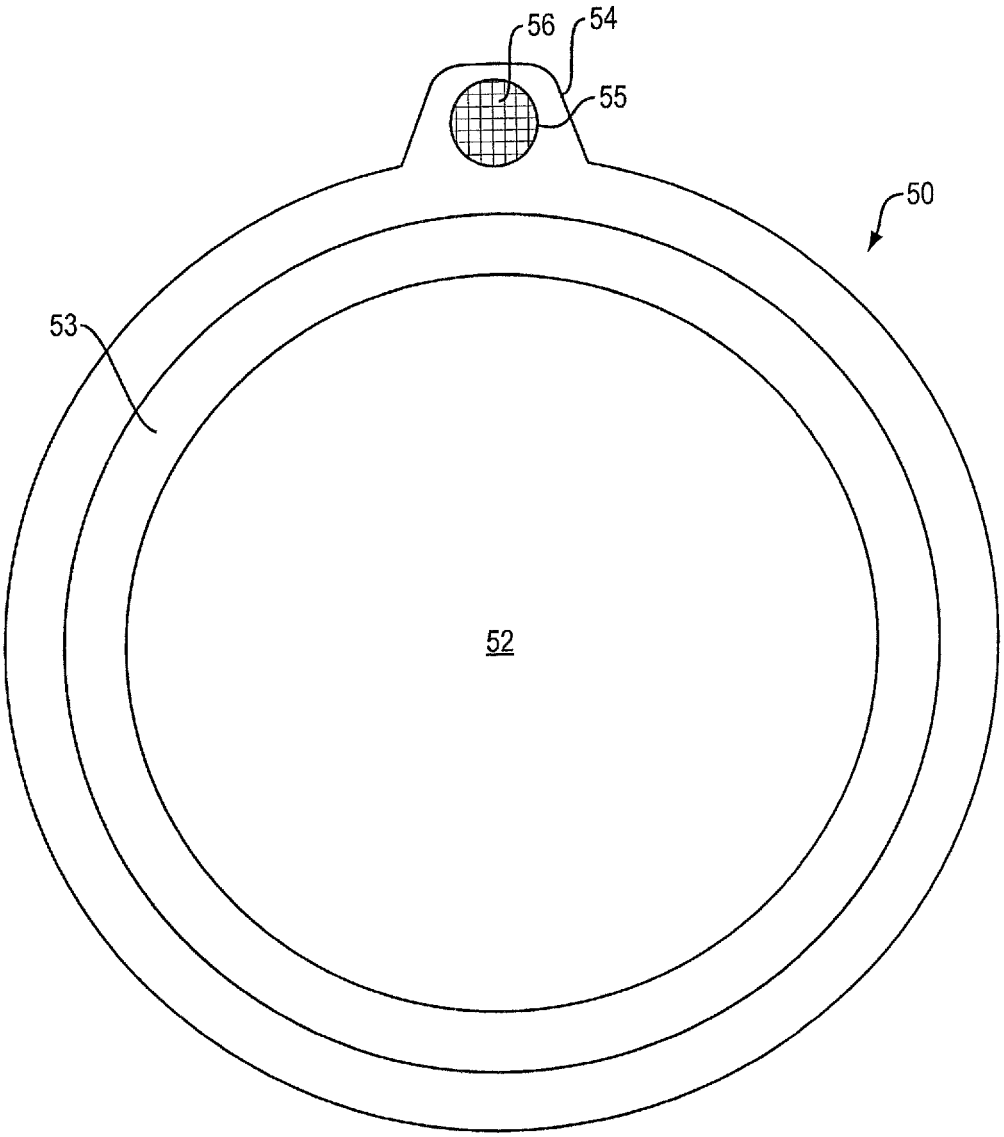
FIG. 3 is a top view of a frame for the electro-acoustic transducer of an earphone.

In one specific, non-limiting implementation of an earphone, the electro-acoustic transducer can be mounted on open frame 50, FIG. 3. Frame 50 is only one non-limiting example of how a PEQ port with an insert molded mesh can be accomplished. For example, the PEQ port with insert-molded mesh could reside in earphone structures other than the frame, and/or the transducer could be mounted in the housing without the use of a mounting frame. Frame 50 can be an integral molded structure that comprises annular seat 53 on which the transducer can sit, opening 52 to accommodate the diaphragm and other structures of the transducer, and extension 54 with through-hole 55 into which mesh material 56 can be insert molded. Hole 55 with integral mesh 56 forms a port, e.g., a PEQ port that directly acoustically connects the front and rear acoustic cavities of the transducer. Frame 50 can be carried inside the earphone housing (not shown) as would be apparent to those skilled in the technical field.

Figure 4:
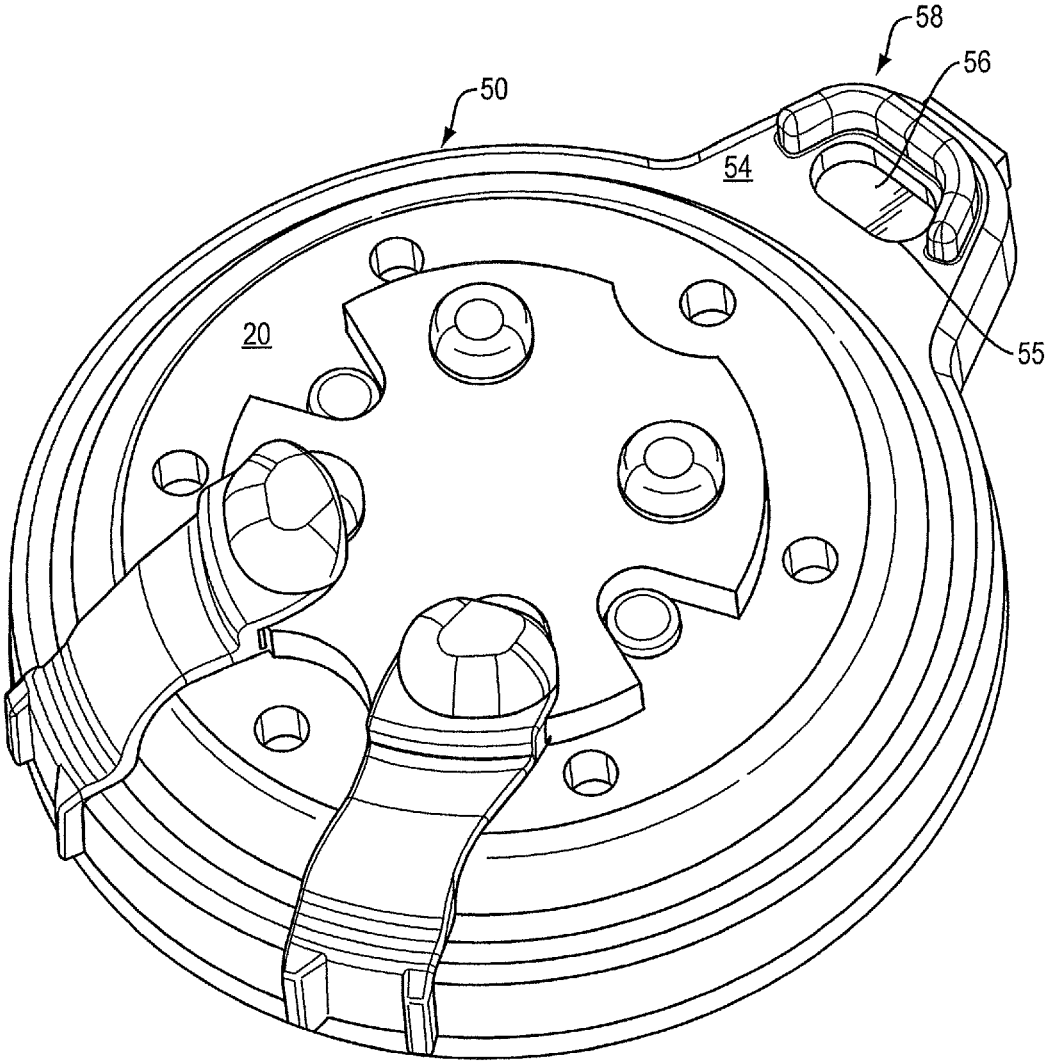
FIG. 4 is a rear perspective view of the frame of FIG. 3 with the transducer mounted in the frame.

FIG. 4 is a rear perspective view of frame 50 and transducer 20 mounted in the frame. In this non-limiting example, a ridge or protrusion 58 is located or placed on top of extension 54 surrounding part of through-hole 55. Ridge 58 can be an integral portion of the molded structure, or can be added separately. A purpose of ridge 58 is to inhibit any adhesive used to mount transducer 20 in frame 50 (or to mount frame 50 in the housing) from being pushed into hole 55 during assembly, as this could cause unwanted and uncontrolled changes to the performance of the PEQ port. The shape of the PEQ port can be optimized for noise. A goal is to conserve the area of the port opening. As depicted, the opening shape may be an elongated oval.

Figure 5:
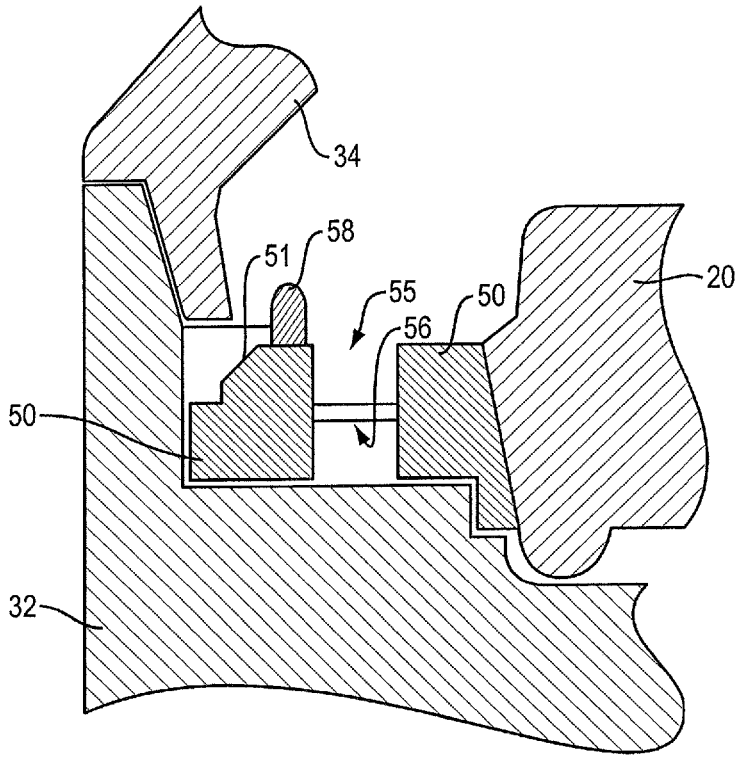
FIG. 5 is a partial cross-sectional view illustrating the frame and transducer of FIG. 4 mounted in the housing.

FIG. 5 is a schematic partial cross-section illustrating a manner in which frame 50 interfits with and is coupled to shells 32 and 34. Transducer 20 can be coupled to frame 50 with adhesive. Frame 50 can carry chamfer 51 that acts as a location at which frame 50 is glued to shell 32. Bead 58 can be located between chamfer 51 and PEQ 55, to prevent adhesive on chamfer 51 from being pushed into the PEQ port as the parts are assembled.

A number of implementations have been described. Nevertheless, it will be understood that additional modifications may be made without departing from the scope of the inventive concepts described herein, and, accordingly, other examples are within the scope of the following claims.

What is claimed is:

1. An earphone, comprising:

a housing that defines a front acoustic cavity and a rear acoustic cavity;

an electro-acoustic transducer in the housing and configured to deliver acoustic energy into the front and rear acoustic cavities;

a generally annular frame that comprises a seat to which the transducer is fixed, wherein the frame defines a nominal outer perimeter;

wherein the frame further comprises an integral extension portion that projects outwardly beyond the nominal perimeter of the frame and encompasses only a small portion of the frame perimeter, wherein the extension portion has opposed first and second faces and a far end that is spaced farthest from the transducer;

wherein the perimeters of the frame and the extension portion are fixed to the housing by adhesive;

a port integrally formed in the extension portion and that acoustically couples the front and rear acoustic cavities, wherein the port comprises an opening through the extension portion and that defines a perimeter where it meets the first face of the extension portion, with a mesh structure that is insert molded into the port and spans the port opening; and a raised bead of material on the first face of the extension portion, proximate the port opening, and extending around at least part of the perimeter of the port opening between the port opening and the outer end of the extension portion wherein the bead inhibits adhesive from entering port opening.

2. The earphone of claim 1, wherein the port comprises an acoustically resistive element.

3. The earphone of claim 1, wherein the port comprises an acoustically reactive element.

4. The earphone of claim 1, wherein the mesh structure comprises a moisture-resistant element.

5. The earphone of claim 1, wherein the mesh structure comprises a woven mesh material.

6. The earphone of claim 1, further comprising a mass port and a resistive port that acoustically couple the rear cavity to an environment external to the earphone.

7. The earphone of claim 1, further comprising a nozzle that is configured to directly deliver acoustic energy from the front cavity into an ear canal.

8. The earphone of claim 7, further comprising a moisture-resistant element mesh material that is insert molded into the nozzle.

9. The earphone of claim 1, further comprising an external port that acoustically couples the rear cavity to an environment external to the earphone and comprises an opening with a woven mesh material that is insert molded into the external port.

10. The earphone of claim 1, wherein the raised bead extends around most of the perimeter of the port opening.

11. The earphone of claim 1, wherein the extension portion perimeter defines two angled sides and an outer end that connects the two sides.

12. The earphone of claim 11, wherein the bead extends proximate and along the entire end, and along parts of the two sides.

13. The earphone of claim 1, further comprising a chamfer in the frame perimeter.

14. The earphone of claim 13, wherein the chamfer extends along the entirety of the perimeter of the frame, including the perimeter of the extension portion.

15. An earphone, comprising:

a housing that defines a front acoustic cavity and a rear acoustic cavity;

an electro-acoustic transducer in the housing and configured to deliver acoustic energy into the front and rear acoustic cavities;

a generally annular frame that comprises a seat to which the transducer is fixed, wherein the frame defines a nominal outer perimeter;

wherein the frame further comprises an integral extension portion that projects outwardly beyond the nominal perimeter of the frame and encompasses only a small portion of the frame perimeter, wherein the extension portion has opposed first and second faces and defines a perimeter with two angled sides and an outer end that connects the sides;

wherein the perimeters of the frame and the extension portion are fixed to the housing by adhesive;

a port integrally formed in the extension portion and that acoustically couples the front and rear acoustic cavities, wherein the port comprises an opening through the extension portion and that defines a perimeter where it meets the first face of the extension portion, with a mesh structure that is insert molded into the port and spans the port opening; and a raised bead of material on the first face of the extension portion, proximate the port opening, and extending proximate and along the entire outer end and parts of the two sides of the extension portion perimeter, wherein the bead inhibits adhesive from entering the port opening.

16. An earphone, comprising:

a housing that defines a front acoustic cavity and a rear acoustic cavity;

an electro-acoustic transducer in the housing and configured to deliver acoustic energy into the front and rear acoustic cavities;

a generally annular frame that comprises a seat to which the transducer is fixed, wherein the frame defines a nominal outer perimeter comprising a chamfer;

wherein the frame further comprises an integral extension portion that projects outwardly beyond the nominal perimeter of the frame and encompasses only a small portion of the frame perimeter, wherein the extension portion has opposed first and second faces;

wherein the perimeters of the frame and the extension portion are fixed to the housing by adhesive;

a port integrally formed in the extension portion and that acoustically couples the front and rear acoustic cavities, wherein the port comprises an opening through the extension portion and that defines a perimeter where it meets the first face of the extension portion, with a mesh structure that is insert molded into the port and spans the port opening; and a raised bead of material on the first face of the extension portion, proximate the port opening and extending around part of the perimeter of the port opening, wherein the bead inhibits adhesive from entering the port opening.

* * * * *